United States Patent [19]

Dining

[11] 4,392,449

[45] Jul. 12, 1983

[54] BELOW DECK ENCLOSURE FOR PRESSURIZED, HEAVIER THAN AIR GAS

[76] Inventor: Bruce F. Dining, R.F.D. #1, Exeter, N.H. 03833

[21] Appl. No.: 259,564

[22] Filed: May 1, 1981

[51] Int. Cl.[3] ..... B63B 11/00

[52] U.S. Cl. ..... 114/343; 114/74 R; 440/88

[58] Field of Search ..... 220/85 R, 85 VR, 85 VS, 220/413, 411, 408; 440/88; 114/74 R, 343; 137/312-314, 899.2

[56] References Cited

U.S. PATENT DOCUMENTS

| | | | |
|---|---|---|---|
| 2,944,563 | 7/1960 | De Blasio | 220/408 |
| 3,110,157 | 11/1963 | Radd | 137/312 |
| 3,115,114 | 12/1963 | Rapplean | 440/88 |
| 3,674,170 | 7/1972 | Thorpe | 9/1.1 |
| 4,014,056 | 3/1977 | Wainwright | 114/74 R |

*Primary Examiner*—Charles E. Frankfort
*Assistant Examiner*—Thomas J. Brahan
*Attorney, Agent, or Firm*—Weingarten, Schurgin, Gagnebin & Hayes

[57] ABSTRACT

An enclosure for the below deck storage of volatile or flammable fluids, in compressed gas tanks which is sealed from the vessel interior, but downwardly vented to the outside so that tank or cannister leaks find a preferred path of safe exhaust while the cannisters are conveniently stored within. The enclosure includes a sealed housing which is adapted to be mounted to a bulkhead in a vessel and which has an opening on one side thereof and a lid removable from the opening in the housing to gain access to the interior thereof. Means are provided for sealing the lid to the housing. The base of the interior of the housing is molded to conform to the shape of a lower end of one or more cannisters containing the pressurized fluid for support of the cannisters within the housing against motion caused by movement of the vessel. The lid is also molded to conform to the shape of the top of the cannisters for restraining further movement of the cannister. A sump is provided at the base of the housing and is vented exteriorly at the vessel for exhaust of leaking fluids. Tubing conducts contents of the cannisters to a regulator, and another length of tubing conducts the contents from the regulator through a hole in the housing to a desired location on the vessel.

4 Claims, 2 Drawing Figures

BELOW DECK ENCLOSURE FOR PRESSURIZED, HEAVIER THAN AIR GAS

FIELD OF THE INVENTION

The present invention relates generally to storage of volatile or flammable fluids and gases in a marine vessel and more particularly to below deck storage of compressed gas cannisters for use on a marine vessel.

BACKGROUND OF THE INVENTION

Volatile and flammable fluids, such as compressed liquified gas, particularly propane, are often required on marine vessels, such as sailboats, yachts, motor boats, cabin cruisers, tug boats and the like, for heating and cooking purposes. However, the storage of most such materials presents a serious problem to operators of vessels in that leakage from the storage tanks or cannisters results in the presence of an explosive gas mixture which settles in low spaces, waiting to be ignited. It is usual, therefore, to find such tanks stored on or above deck where leaked gases readily flow overboard. Such storage is often inconvenient, usually unsightly, and conducive of corrosion, but it is almost universally practiced due to safety considerations.

A typical example of such an above deck facility is shown in U.S. Pat. No. 4,014,056. In such a device, where consumption of the gas occurs below deck in the galley or cabin areas, long exposed fuel lines are required. Cannisters stored above deck are also more easily corroded from salt spray. Containers for below deck storage are known and available, but none of them provide adequate ventilation for gas cannisters or support to prevent the cannisters from moving about. An example of a below deck storage bin for other purposes is shown in U.S. Pat. No. 3,674,170.

SUMMARY OF THE INVENTION

The present invention provides a safe, easily accessible enclosure for storage below deck on a marine vessel of one or more cannisters of pressurized volatile or flammable fluids, such as liquid propane gas. The enclosure includes a sealed housing which is preferably of one-piece construction and which is adapted for mounting to a bulkhead on a marine vessel at a desired location above the water line. The housing is vented downwardly through the vessel hull to the outside. As a result, a compartment is created within the housing which is sealed from the interior of the vessel but which opens to the outside so that any leakage is safely an easily exhausted.

The housing has an opening providing access to the interior thereof and a removable lid covering the opening. Means are provided for securing the lid to the housing to seal the opening. This sealed housing both prevents leakage of gases or liquids therefrom and protects the cannisters from salt spray. The bottom surface of the housing is molded to conform to the shape of one end of a cannister containing a fluid to provide a bottom support therefor. Preferably, two of such bottom supports are provided for inclusion of a spare cannister. Each of these bottom supports is capable of retaining a cylindrical cannister in a vertical position and preventing it from moving horizontally at its bottom end. Similar molded top supports are provided on the underside of the lid in association with each cannister, so that the top of each cannister is also restrained. A sump is provided on the bottom surface of the housing, and a drain empties exteriorly of the vessel through the hull for venting of any gases or liquids leaking from the containers or from the fittings associated therewith. The sump is typically vented above the water line so that no pressure is required to produce venting. A hose extnds from the valve of each container to a regulator, and another hose extends from the regulator through a gasketed and sealed hole in the housing wall for ducting of the fluids externally of the housing.

The within invention typically is mounted below deck, and secured to a bulkhead wall, although it may be positioned above deck, if desired. If mounted below deck, a deck hatch is typically provided adjacent thereto for easy access to the enclosure opening for replacement of the cannisters.

DESCRIPTION OF THE DRAWING

The objects, advantages and features of this invention will be more clearly appreciated from the following detailed description taken in conjunction with the accompanying drawing in which.

DETAILED DESCRIPTION OF THE PREFERRED EMBODIMENT

Figure 1:
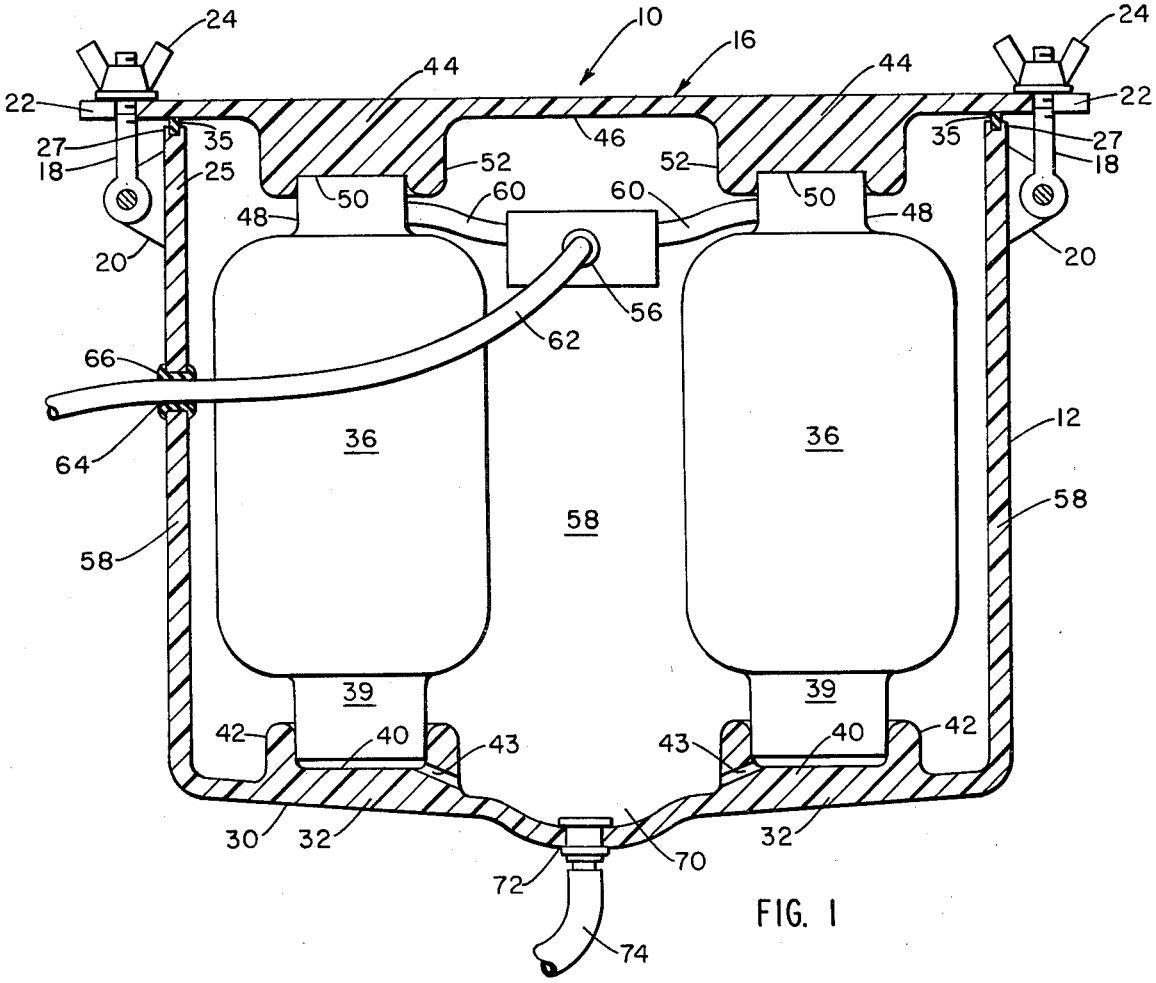
FIG. 1 is a cross-sectional view of the enclosure of FIG. 1.

With reference to the drawing and more particularly to FIG. 1 thereof, there is shown a cross-sectional view of enclosure 10 of this invention. Enclosure 10 includes a housing 12 which is typically formed of a one-piece construction and which has vertical walls 58 and a bottom wall 30. Housing 12 is open at the top where it is adapted to be sealed by a lid 16 which is preferably formed of the same material as housing 12. Lid 16 typically overlaps upper edge 25 of the opening to completely cover the opening, to permit lid 16 to be grasped for removal thereof, and to permit easy attachment of the lid to the housing. Means are provided for releasably and sealingly securing lid 16 to the housing. The lid securing means typically includes a plurality of pivotally disposed bolts 18, although other conventional closures would also be suitable. Only two bolts 18 are shown on opposite sides of enclosure 12 in FIGS. 1 and 2, however, additional bolts 18 may be provided as needed to properly seal lid 16 to housing 12. Each bolt 18 is pivotally secured at one end to a mount 20 disposed on the side of housing 12. Cooperating slots 22 are formed extending longitudinally inwardly from the edge on the overlapping portion of lid 16 so that as each bolt 18 is pivoted upwardly, its upper end may slide through an associated slot 22 to be vertically positioned as shown in FIG. 1. A nut, typically a wing nut 24, is provided in association with each bolt 18 to clamp lid 16 against housing 12. Conventional means typically are provided to prevent loosening of wing nut 24 on bolt 18 greater than a desired amount so that wing nut 24 does not become separated from bolt 18 and lost. Wing nut 24 or an associated washer has a diameter greater than the lateral width of slot 22 so that the lower surface of wing nut 24 or its washer will engage the upper surface of lid 16 and will not slip through slot 22. O-ring gasketing is provided between the lid 16 and housing 12. For this purpose, a gasket 35 is provided in a slot 27 extending around the upper edge 25 of the opening so that as lid 16 is clamped downwardly by wing nuts 24 and bolts 18, a seal is provided between the interior surface 46 of lid 16 and edge 25. Gasket 35 may be any commercially available O-ring seal which has sufficient resiliency and endurance to provide the necessary seal.

Disposed along a bottom wall 30 of housing 12 are a plurality of lower cannister supports 32, as shown in FIG. 1. Lower supports 32 are configured to conform to the shape of a lower end of a cannister 36 to be stored within the enclosure. The type of cannister which may be stored within the enclosure includes those containing a compressed gas, or any other volatile or flammable fluid required to be stored on a marine vessel for use thereon. Lower supports 32 typically are molded from the material of bottom wall 30 and are formed integrally therewith. Lower supports 32 serve to both maintain a cannister 36 in a vertical or upright position and to prevent movement of lower end 39 thereof. Lower supports 32 are provided with a recess 40 formed between circular, raised shoulders 42, the diameter of recess 40 being carefully dimensioned to be the same as that of the outside diameter of lower end 39 of cannister 36 so that shoulders 42 fit snugly around end 39. Shoulders 42 should be raised from the surface of bottom wall 30 sufficiently to provide lateral support to cannister 36 to prevent tipping thereof. Apertures 43 may be provided through shoulders 42 for drainage. Since lower supports 32 must be precisely configured, enclosure 10 generally is custom designed for a particular type of cannister with which the enclosure is to be utilized, and the number of supports 32 desired may be determined during assembly thereof. Typically, two supports 32 are provided for two cannisters 36 within the enclosure.

A plurality of upper cannister supports 44 are provided on the interior surface of lid 16. As with lower cannister supports 32, upper cannister supports 44 typically are molded from the material of lid 16 and are formed integrally therewith. Upper cannister supports 44 are configured to conform to the shape of upper end 48 of cannister 36 and include a recess 50 formed by raised shoulders 52. Recess 50 is carefully dimensioned to have the same diameter as the outside diameter of upper end 48 of each cannister so that shoulders 52 fit snugly about upper end 48 to prevent lateral movement thereof. An upper cannister support 44 is disposed vertically opposite each lower cannister support 32 for capturing an associated cannister 36 therebetween. Lid 16 is secured to housing 12 in the manner previously described, lid 16 exerts a clamping effect downwardly on cannisters 36 driving upper ends 48 thereof more securely into recesses 50 and driving lower ends 38 thereof more securely into recesses 40. Thus, cannisters 36 are securely captured and held in place by upper cannister supports 44 and lower cannister supports 32 to prevent shifting thereof or any other movement relative to the enclosure during rocking or pitching movements of the marine vessel upon which the enclosure is mounted.

A pressure regulator 56 is mounted to one of the vertical walls 58 of housing 12 and is connected to the outlet valve of each cannister 36 within housing 12 by tubing 60. Regulator 56 may be any conventional fluid flow regulator known to the art. Another piece of tubing 62 extends from an outlet valve of regulator 56 through a hole 64 in one of the vertical walls 58 of housing 12. Typically, tubing 62 is a unitary piece of tubing which extends from the outlet valve of regulator 56 to the device to which the contents of cannisters 36 are to be supplied. A gasket 56 is provided in opening 64 for sealing the opening around tubing 62.

Since housing 12 is typically formed of a unitary piece, and since gasket 56 and gasket 26 are provided, housing 12 is sealed when cover 16 is in place, thereby preventing the escape of any fluids and gases that may leak from cannisters 36, regulator 56, tubing 60, tubing 62 or from any of the fittings. If this fluid or gas were to leak from the interior of the enclosure, it could present a serious hazard to the occupants of the boat by either igniting portions of the boat, causing an explosion if allowed to become trapped in a hold or other enclosed area of the boat, or by asphyxiating the occupants. In addition, the sealing of the enclosure prevents the entry therein of any salt spray which could cause corrosion of cannisters 36 and the fittings associated therewith. Tubing 60 and 62 may be of a high pressure hose.

To vent any leaking gases or other fluids, a sump 70 is provided. Sump 70 includes a depression formed in lower wall 30 in which leaking gases may collect. Sump 70 is typically centrally disposed on wall 30, although it need not be. A drain 72 is provided at the lowest portion of sump 70 to permit the venting of gases collected therein. Drain 72 communicates with the ambient atmosphere exterior of the vessel through a hose 74 connected to appropriate fittings in drain 72. Hose 74 extends through the wall of the vessel, as will be described. Since most gases and the liquified fluids utilized on a vessel are heavier than air and since sump 70 is positioned at the lowest point in wall 30, and by insuring that shoulders 42 are circular and do not extend to any vertical wall 58 of housing 12 to trap fluids, all fluids leaking within the enclosure will collect in sump 70 for venting thereof. Sump 70 may also be disposed at the juncture of lower wall 30 and one vertical wall 58. In this embodiment, lower wall 30 is disposed at an angle with respect to the horizontal and extends downwardly toward the sump so that all leaking fluids flow along wall 30 until they abut the one vertical wall 58 and can be vented by the sump.

Figure 2:
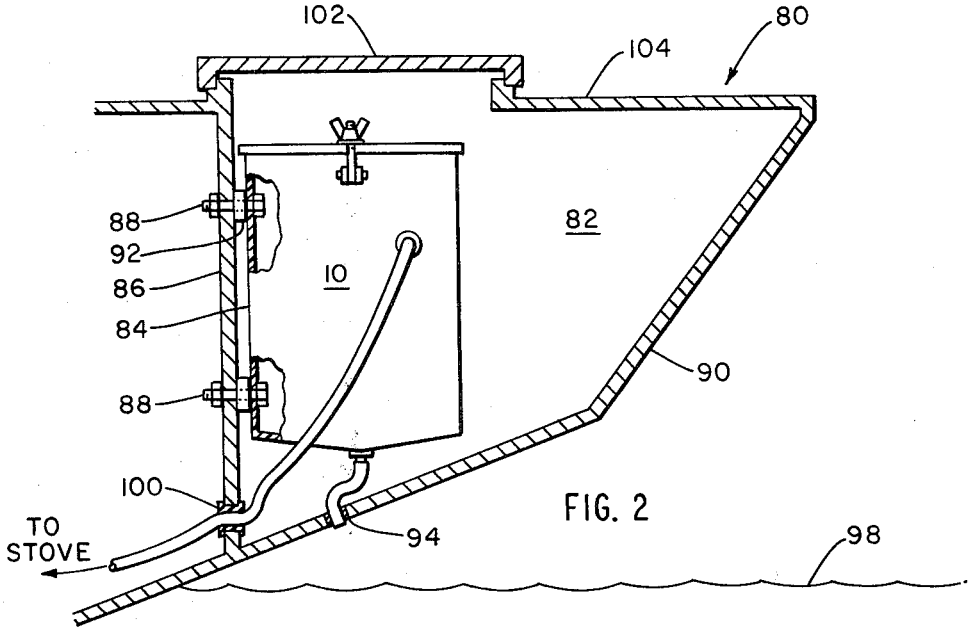
FIG. 2 is a partially cutaway, pictorial view of the enclosure of this invention mounted within the bow of a boat.

FIG. 2 illustrates an exemplary deployment of enclosure 10 within a vessel 80. Typically, enclosure 10 is mounted within a lazaret 82 or hold of vessel 80 although enclosure 10 may be mounted elsewhere, or even above deck if desired. In the deployment of FIG. 2, enclosure 10 is positioned in an aft lazaret 82, although the enclosure may be disposed in any other portion of the vessel where convenience and available space may dictate. Enclosure 10 typically is positioned directly below a hatch 102 on deck 104 of the vessel to provide easy access to the enclosure for replacement or removal of the cannisters. Hatch 102 may be any standard deck hatch with a cover, and should be positioned directly over the enclosure and be larger than cover 16 so that cover 16 may be conveniently removed. Enclosure 10 is mounted in spaced relation with hull 90 within lazaret 82 by mounting thereof to bulkhead 86. This mounting may be accomplished in any conventional manner, such as by bolts 88 which extend from vertical wall 58 of enclosure 10 and through bulkhead 86. Typically, wall 58 is spaced from bulkhead 86 by means of shims or spacers 96 to permit cover 16 to overlap upper edge 28 of housing 12 as described and to permit cover 16 to be removed without interference from bulkhead 86.

Hose 74 passes through a gasketed hole 94 in the bottom of hull 90 for venting of sump 70. It is desirable that hose 74 be vented above the water line 98 and that it be vented below the lowest portion of sump 70 for proper exhausting thereof. If the sump were vented below the water line, pressure could build up within the housing promoting leaks, and water could back up into the sump and flood it. Hose 74 could alternatively extend through a sidewall of hull 90. In the embodiment in which bottom wall 30 is sloped from one end to the other, and in which the sump is adjacent a side wall 58, the sump vent may extend laterally from side wall 58 at the lower end thereof adjacent bottom wall 30, and a vent hose may extend through the side of the hull of the boat rather than through the bottom as shown in FIG. 2. This embodiment of the sump may be desired where the vessel sits lower in the water than that shown in FIG. 2 or where the enclosure is placed in a position lower within the hold of the vessel than shown in FIG. 2 so that the bottom of the enclosure is very near the water line. Tubing 62 extends through lazaret 82 and passes through bulkhead 86 at gasketed hole 100 directly to a stove or lamp or other facility requiring use of the contents of cannister 36. Hole 100 may be provided at any point in bulkhead 86 that is convenient, whether it be at the bottom thereof as shown in FIG. 2 or at a higher level.

The use of the enclosure of this invention will now be described with reference to FIGS. 1 and 2. When it is desired to replace cannisters 36 within housing 12, the cover of hatch 102 on deck 104 is first removed. Wing nuts 24 are then unscrewed sufficiently far to permit bolts 18 to be pivoted downwardly about mounts 20 so that bolts 18 no longer reside in their associated slots 22 but rather hang downwardly from mount 20. Cover 16 may then be removed and raised out through hatch 102. Next, tubing 60 connecting the cannister valves to the regulator is removed from the cannister valves. Once tubing 60 has been disconnected from both cannisters 36, the cannisters may be raised from lower supports 32 and lifted out through hatch 102. Thereafter, new, filled cannisters 36 may be lowered through hatch 102 and into position on lower supports 32. The weight of cannisters 36 and a push from the operator will cause cannisters 36 to settle into position between tightly fitting shoulders 42 in a generally vertical orientaton. Tubing 60 then is reconnected to the valves of cannisters 36, and cover 16 may be replaced. Shoulders 52 on cover 16 are forced over upper end 48 of cannisters 36 by applying downward pressure on cover 16 so that cannisters are firmly captured between lower supports 32 and upper supports 44. Bolts 18 are pivoted to the vertical position shown in FIG. 1 and wing nuts 24 are tightened against cover 16 to urge interior surface 46 of cover 16 against gasket 26 to ensure a proper seal around the opening. Then, the cover of hatch 102 can be replaced and the operation is complete. This replacement procedure is easy to accomplish, since the wing nuts are easily removed, and the only fitting that needs to be loosened or replaced is that surrounding the outlet valve of the cannisters. No other hardware, brackets or fittings need be removed or replaced when the cannisters are exchanged for fresh ones.

The enclosure of this invention can be mounted anywhere below decks where convenient, as long as the enclosure is positioned sufficiently high to permit venting of the sump above the water line. Typically, the enclosure is mounted to a bulkhead in an aft lazaret just below a hatch cover, as illustrated herein, although such a mounting is only exemplary and is not intended to limit the scope of the invention. It is only important is that access be provided to the cover of the enclosure for replacement or removal of the cannisters. The hose extending from the enclosure to a stove or lamp or other consumer of the contents of the cannisters need not be channeled along the bottom of the boat, as shown in FIG. 2, but may extend in any direction desired to any level, since the fluid within the cannisters is under pressure. This enclosure may be used in any sort of marine vessel, such as a sailboat, a yacht, a motor boat, a cabin cruiser, tug boat or a much larger vessel. The enclosure provides a safe, convenient means of storing cannisters of compressed gas or other volatile or flammable fluids for use on a boat off the deck while maintaining an ambient external vent. In addition, the cannisters are protected from the salt spray which may tend to corrode them and corrode the fittings.

For reference purposes, examples of the dimensions of an exemplary enclosure of this invention are set forth. It is to be understood that by providing such examples, the scope of the invention is in no way limited. For standard compressed gas cannisters, the enclosure typically has a height of about 22 inches, a length of about 28 inches, and a width of approximately 12 inches. Shoulders 42 and 52 are of a height consistent with the lengths of ends 40 and 48 and the access needs for the tubing 60. One-half inch diameter hose is frequently used although any size hose which will accommodate the valve fittings of the cannister may be used. Housing 12 and cover 16 typically are formed of a rigid plastic material, such as fiberglass or high density plastic. Preferably, supports 32 and 44 are formed of the same material as are cover 16 and housing 12.

The above description is exemplary, and it is likely that modifications and improvements would be contemplated which are within the scope of this invention as defined in the following claims.

What is claimed is:

1. An enclosure for volatile or flammable heavier than air gases stored as fluids under pressure in cannisters on a marine vessel comprising:

a sealable housing having an opening on one side thereof;

a removable lid covering the opening of said housing;

means cooperating with said lid and housing for sealing the lid and housing together thereby to define a sealed interior of said housing;

support means within said housing for maintaining said cannisters in a predetermined orientation within the sealed interior of said housing;

means adapted to mount said housing to a substantially vertical bulkhead of a vessel thereby to maintain said cannisters in an upright condition;

sump means disposed on the bottom of said housing in a depressed portion thereof whereby said sump means is at the vertically lowest point of said housing when bulkhead mounted; and free flow conduit means for venting said sump vertically downward to a point external of said vessel above the water line and below said sump means whereby the sealed interior of said housing, external of the cannisters therein, is vented downward to the exterior of said housing for free flow exhaust of heavier than air gases from said housing to the exterior of said vessel.

2. The enclosure of claim 1 wherein:

said housing is adapted for containing a plurality of said cannisters; and regulator means are provided for combining gas from each cannister into a single conduit.

3. The enclosure of claims 1 or 2 further including: means for sealing said free flow conduit means at said housing.

4. The enclosure of any one of claims 1 or 2 wherein said means for mounting said enclosure to said bulkhead of said vessel maintains said enclosure above the water line.

* * * * *